United States Patent [19]

Lyman

[11] Patent Number: 4,721,256

[45] Date of Patent: Jan. 26, 1988

[54] COMMINUTION OF COAL, ORES AND INDUSTRIAL MINERALS AND ROCKS

[75] Inventor: Geoffrey J. Lyman, Tarragindi, Australia

[73] Assignee: University of Queensland, Queensland, Australia

[21] Appl. No.: 852,309

[22] PCT Filed: Jul. 26, 1985

[86] PCT No.: PCT/AU85/00173

§ 371 Date: Mar. 25, 1986

§ 102(e) Date: Mar. 25, 1986

[87] PCT Pub. No.: WO86/00827

PCT Pub. Date: Feb. 13, 1986

[30] Foreign Application Priority Data

Jul. 26, 1984 [AU] Australia ..... PG6235

[51] Int. Cl.[4] ..... B02C 19/18

[52] U.S. Cl. ..... 241/1; 241/23; 241/29; 241/DIG. 37

[58] Field of Search ..... 241/23, 24, 1, DIG. 37, 241/301, 65, 29

[56] References Cited

U.S. PATENT DOCUMENTS 3,991,943 11/1976 Rohrbach .
4,102,503 7/1978 Meinass ..... 241/DIG. 37 X
4,131,238 12/1978 Tarpley .
4,156,593 5/1979 Tarpley .
4,273,294 6/1981 Hollely et al. .
4,302,112 11/1981 Steenstrup .

FOREIGN PATENT DOCUMENTS 76039 8/1982 Australia .
63789 4/1983 Japan .
1217923 1/1971 United Kingdom .
1315518 5/1973 United Kingdom .

*Primary Examiner*—Mark Rosenbaum
*Attorney, Agent, or Firm*—Schwartz, Jeffery, Schwaab, Mack, Blumenthal & Evans

[57] ABSTRACT

Crushed particles of coal, ores or industrial minerals or rocks are comminuted by feeding them through a feeder (14) into a cyclic stream (19, 22, 38, 39, 41) of cryogenic process fluid such as liquid carbon dioxide and conducting the process stream with the entrained mineral particles to a comminuter (17) and through a zone therein of mechanically generated high frequency vibratory energy, preferably ultrasonic. The comminuter (17) may be multistage with means for re-cycling oversize mineral particles and, after leaving the comminuter (17) the process stream (38) is conveyed to a separator (18) for extracting the comminuted particles and re-cycling the cryogenic fluid to the feeder (14). The low temperature of the process stream is maintained by refrigerating means (16) and losses of the fluid are made up by supplementary fluid fed to the stream.

8 Claims, 2 Drawing Figures

COMMINUTION OF COAL, ORES AND INDUSTRIAL MINERALS AND ROCKS

BACKGROUND OF THE INVENTION (1) Field of the Invention

This invention relates to a method of and apparatus for the fine comminution of coal and other mineral matter such as ores of base metals, iron ore and, more generally, all materials described as industrial minerals and rocks (hereinafter referred to as "minerals").

(2) Prior Art

A process and apparatus for the ultrasonic comminution of solid materials are described in the specification of U.S. Pat. No. 4,156,593 of W. B. Tarpley Jr., and a process of ultrasonic homogenisation or emulsification is disclosed in the specification of U.S. Pat. No. 4,302,112 of P. R. Steenstrup. A process and apparatus for continuation by sonic high frequency impacting or crushing are described in the specification of Australian Pat. No. 544,699 of A. G. Bodine.

SUMMARY OF THE PRESENT INVENTION

The present invention has for its objects the provision of a method and apparatus by means of which the fine comminution of minerals may be carried out particularly efficiently. According to the invention a mineral, such as coal for example, which has been crushed in a hammermill or like apparatus, is introduced by a feeder to a cyclic stream of cryogenic fluid, such as liquid carbon dioxide or liquid nitrogen for example, by which the entrained mineral particles are carried through a comminutor applying mechanically generated high frequency vibratory energy, the cryogenic fluid and comminuted mineral being then conducted to a separator by which the comminuted mineral is separated from the fluid and discharged, the fluid being re-cycled to the feeder. In a primary heat exchanger the fluid from the feeder is pre-cooled by fluid passing from the comminuter to the separator, and the fluid is further cooled to the required operating temperature before reaching the comminutor by refrigerant in a secondary heat exchanger.

DETAILED DESCRIPTION OF THE PREFERRED EMBODIMENT

Figure 1:
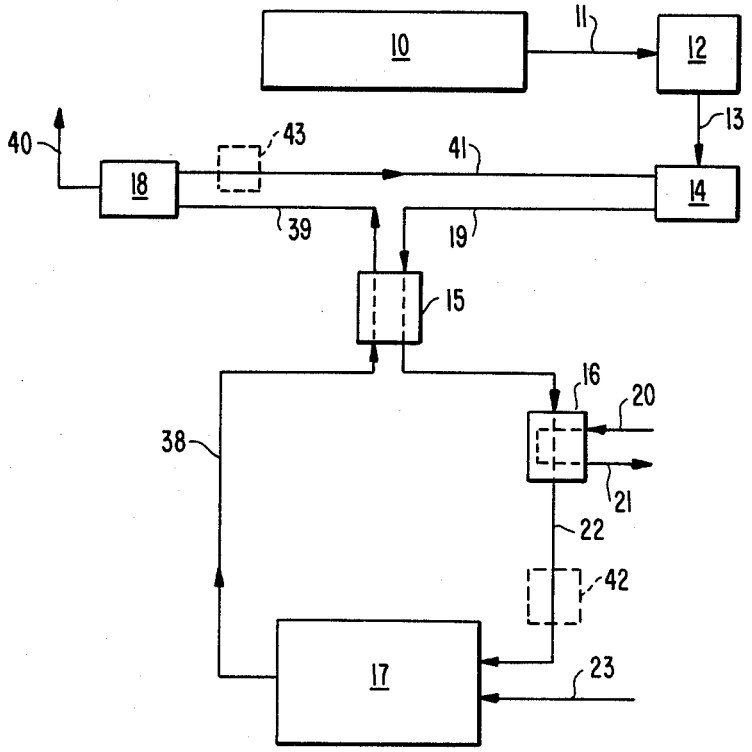
FIG. 1 is a diagrammatic illustration of a continuous comminution installation according to the invention.

The installation shown in the drawings is devised for the comminution of coal, but it is to be understood that it is applicable, with modifications if necessary or desirable, to the treatment of other minerals as set out above.

The installation includes a primary crusher 10, which may be a hammermill or other known device capable of economically reducing coal introduced to it to a size of the order of one to ten millimeters.

The crushed coal is conveyed by way of stream 11 to a storage hopper 12 from which it is drawn as required and conveyed at ambient temperature, by way of stream 13, to a feeder 14.

The continuous comminution process involves the introduction of the crushed coal to a cryogenic process fluid and its conveyance by this fluid in sequence from the feeder 14, through a primary heat exchanger 15, through a secondary heat exchanger 16, through a high frequency comminuter 17, back through the primary heat exchanger 15 and to a mineral-fluid separator 18 where the comminuted coal is discharged and the cryogenic process fluid is recycled through the feeder 14.

Any of a number of cryogenic fluids may be used as the process fluid, liquid carbon dioxide being a suitable medium, as also is liquid nitrogen, although other elements or compounds that remain liquid below about −40° C. such as the inert gases or low molecular weight alkanes (methane to nonane for example) or mixtures of these, or, more generally, components of natural gas, may be used.

The continuous processing system has an internal operating pressure selected to suit the properties of the process fluid used; for example if carbon dioxide is employed, the internal operating pressure must be in excess of 5.11 atmospheres to maintain the carbon dioxide in the liquid state.

The feeder 14 may be a lockhopper or equivalent device capable of introducing the crushed coal received from the storage hopper 12 into the stream of cryogenic process fluid which has been separated from the comminuted coal in the mineral-fluid separator 18. The stream of process fluid and crushed coal carried thereby travels by stream 19 through the primary heat exchanger 15 where it is pre-cooled as before described, and to the secondary heat exchanger 16 where it is further chilled, by a suitable refrigerant stream 20, 21, to the operating temperature of the comminutor. The process fluid and entrained crushed coal are fed to the comminutor 17 via stream 22, and supplementary cryogenic fluid is added to the system, prior to the comminution process, by stream 23 to make up any losses of the fluid that may have occurred as a result of the final separation of the product from the process fluid, or as a result of any losses of the fluid at any other point in the system.

Figure 2:
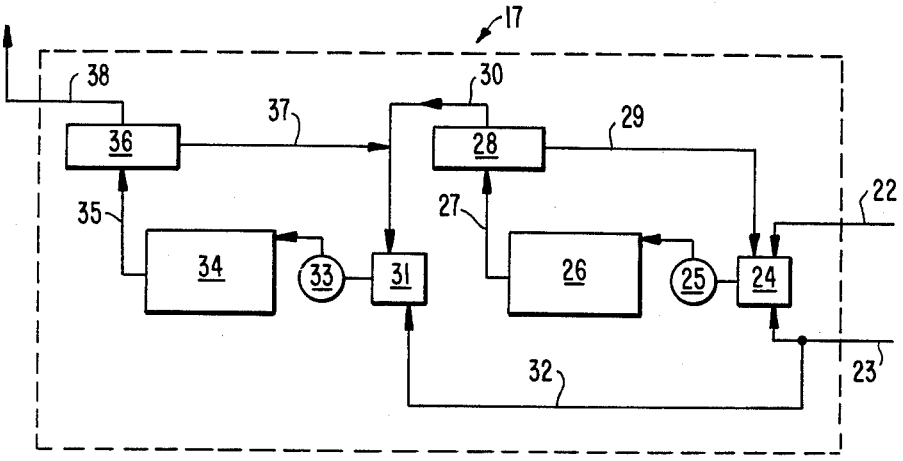
FIG. 2 is a diagram of the comminuting apparatus of the installation.

Referring now to FIG. 2, the comminutor assembly 17 diagrammatically illustrated is of two-stage type. It is a sealed refrigerated unit, to prevent or reduce thermal losses in the system, and it includes a first sump 24 into which is introduced the process stream 22 with entrained coal particles and also the supplementary process fluid via stream 23. From the sump 24 the slurry of process fluid and crushed coal is directed by a pump 25 to a first ultrasonic comminution apparatus 26 which may be of the type described in the specification of said U.S. Pat. No. 4,156,593 of W. B. Tarpley, Jr. The slurry of process fluid and comminuted coal is then directed via stream 27 to a classifier 28 which separates from the slurry such coal particles which are of greater than required size and which are returned by way of stream 29 to the first sump 24 for re-treatment, the balance of the coal particles being conveyed by process fluid in a stream 30 to the second stage of the comminutor, being fed into a second sump 31, to which supplementary process fluid is conveyed by stream 32 from stream 23. The slurry is pumped by a second pump 33 to a second ultrasonic comminution apparatus 34, similar to the first such apparatus 26 and thence, by stream 35 to a second classifier 36, oversize particles of coal being recycled by stream 37, to the second sump 31. A slurry of process fluid carrying finally treated particles is directed via stream 38 through the primary heat exchanger 15, as shown in FIG. 1, to pre-chill the downstream process fluid of stream 19, the two streams being, of course, separated in the heat exchanger. Finally the process fluid and comminuted coal particles travels by way of stream 39 to the mineral-fluid separator 18, the separated comminuted particles exiting therefrom in stream 40, the cryogenic process fluid being re-cycled, via stream 41, to the feeder 14.

As the process fluid may be contaminated by ingress of air at the feeder 14, and by hydrocarbon gases adsorbed to or absorbed in the coal particles, it is preferred that there be included in the cycle a purifier 42 for the elimination of these extraneous gases. A condensor 43 may be introduced in the stream 41 from the mineral-fluid separator 18 to the feeder 14.

It will be found that the effectiveness of the process of comminution of the mineral in the process fluid in zones of mechanically induced high frequency energy density is very materially increased by the low temperature conditions at which the operation takes place. Such conditions cause the development of internal thermal stresses and overall embrittlement of the mineral particles to yield a continuous process for the comminution. The process is efficient in either or both of the following respects:

(i) a reduction in the energy density required to achieve a particular degree of comminution of unit mass of the mineral, (ii) an increase in the degree of liberation of mineral substance constituents, one from another, that is achieved at a particular energy density per unit mass of material. The enhancement of liberation simplifies and reduces the cost of subsequent mineral separation processes.

The use, as a process fluid, of liquified relatively chemically inert gases such as carbon dioxide or nitrogen gives the comminution process the advantage of preventing the oxidation of the mineral surfaces that may occur in conventional processes. This lack of oxidation will, in cases such as coal agglomeration or sulfide flotation processes, make the valuable minerals or components more readily separated from the remaining non-valuable components of the mineral mixture.

The use of hydrocarbon gases as the process fluid or the use of a mixture of condensed hydrocarbon gases and liquid carbon dioxide will, in some mineral beneficiation processes, cause such alteration of the physiochemical properties of the mineral surfaces as will render subsequent beneficiation or mineral separation processes more efficient.

Where the process fluid used is a suitable medium for further processing or beneficiation of the comminuted mineral mixture, the separator 18 may be omitted and the slurry of the comminuted particles in the fluid may pass to a downstream process. In this case, of course, the cryogenic process fluid is fed to the feeder 14 from a source of supply rather than recycled from the separator 18 as before described.

I claim:

1. A method of comminuting minerals in a continuous comminution system including the steps of:

(a) crushing the minerals to form mineral particles;

(b) conveying the mineral particles to a feeder;

(c) separately conveying to the feeder a stream of cryogenic process fluid in the form of a liquified relatively chemically inert gas selected from the group consisting of liquid carbon dioxide and liquid nitrogen;

(d) combining the mineral particles and said cryogenic process fluid and conveying the particles in the stream of cryogenic fluid to a comminutor;

(e) passing said mineral particles and said process fluid through a zone in said comminutor comprised of mechanically induced high frequency vibratory energy thereby comminuting said mineral particles; and (f) separating the comminuted particles from the cryogenic stream of process fluid.

2. A method according to claim 1 wherein the cryogenic process fluid, after separation of the comminuted particles therefrom, is recycled through the feeder, and feeding supplementary cryogenic fluid into the process stream to make up losses of fluid therefrom.

3. A method according to claim 1 wherein the stream of cryogenic fluid, upstream from the comminutor, is pre-cooled in a primary heat exchanger by the cryogenic stream downstream from the comminutor, and the pre-cooled cryogenic stream is further cooled by a refrigerant in a secondary heat exchanger upstream of the comminutor.

4. A method according to claim 1 wherein the stream of cryogenic process fluid is passed through a purifier for extracting from the stream air or gases adsorbed to or absorbed in the mineral particles.

5. A method according to claim 1 wherein the high frequency energy of the zone within the comminutor is ultrasonic.

6. A method according to claim 1 wherein said comminuted particles after leaving said zone are conveyed with said stream of process fluid to a second zone of mechanically enhanced high frequency vibratory energy for still further comminuting said particles.

7. A method according to claim 1 further including the step of maintaining an internal operating pressure in the system at least slightly greater than the pressure required to keep said process fluid in a liquified state.

8. A method of comminuting minerals in a continuous comminution system including the steps of:

(a) crushing the minerals to form mineral particles;

(b) conveying the mineral particles to a feeder;

(c) separately conveying to the feeder a stream of cryogenic process fluid selected from the group consisting of hydrocarbon gases, and a mixture of condensed hydrocarbon gases and liquid carbon dioxide;

(d) combining the mineral particles and said cryogenic process fluid and conveying the particles in the stream of cryogenic fluid to a comminutor;

(e) passing said mineral particles and said process fluid through a zone in said comminutor comprised of mechanically induced high frequency vibratory energy thereby comminuting said mineral particles; and (f) separating the comminuted particles from the cryogenic stream of process fluid.

* * * * *